US009790827B2

(12) United States Patent
Yamada et al.

(10) Patent No.: US 9,790,827 B2
(45) Date of Patent: Oct. 17, 2017

(54) POSITIVE CRANKCASE VENTILATION ("PCV") VALVE MOUNTING STRUCTURE

(71) Applicant: AISAN KOGYO KABUSHIKI KAISHA, Obu-shi, Aichi-ken (JP)

(72) Inventors: Shigeki Yamada, Nagoya (JP); Masahiro Kida, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 106 days.

(21) Appl. No.: 14/923,936

(22) Filed: Oct. 27, 2015

(65) Prior Publication Data

US 2016/0123199 A1 May 5, 2016

(30) Foreign Application Priority Data

Nov. 4, 2014 (JP) ..... 2014-224163

(51) Int. Cl.
*F01M 13/00* (2006.01)

(52) U.S. Cl.
CPC . *F01M 13/0011* (2013.01); *F01M 2013/0038* (2013.01)

(58) Field of Classification Search
CPC ..... F02M 35/10222; F02M 35/10078; F02M 35/10144; F02M 35/10255; F02M 35/10229; F02M 35/10354; F01M 13/022; F01M 13/00; F01M 13/028; F01M 2013/0083; F01M 2013/0044; F02D 2250/08
See application file for complete search history.

(56) References Cited

U.S. PATENT DOCUMENTS 6,880,538 B2 * 4/2005 Ishizuka ..... F01M 13/0416 123/572
7,789,066 B2 * 9/2010 Torii ..... F02D 9/103 123/336
8,171,913 B2 * 5/2012 Sano ..... F02D 9/02 123/184.56
8,955,501 B2 2/2015 Tanikawa et al.
2008/0099000 A1 * 5/2008 Suzuki ..... F01M 13/0011 123/574
2011/0203559 A1 * 8/2011 Tanikawa ..... F01M 13/023 123/572

(Continued)

FOREIGN PATENT DOCUMENTS

JP 2011-169258 A 9/2011

*Primary Examiner* — Long T Tran
(74) *Attorney, Agent, or Firm* — Conley Rose, P.C.

(57) ABSTRACT

A positive crankcase ventilation (PCV) valve mounting structure has a blow-by gas passage with an upstream-side passage portion and a down-stream-side passage portion positioned in a cylinder head and an intake manifold, respectively. The blow-by gas passage may receive the PCV valve therein such that an upstream side portion of a valve case of the PCV valve is positioned within the upstream-side passage portion and that a downstream side portion of the valve case is positioned within the down-stream-side passage portion when the cylinder head and the intake manifold are joined together. A gasket may seal the cylinder head to the intake manifold and may include a seal portion positioned between the valve case of the PCV valve and at least one of the cylinder head and the intake manifold.

12 Claims, 3 Drawing Sheets

(56) References Cited

U.S. PATENT DOCUMENTS

| | | | | |
|---|---|---|---|---|
| 2013/0213370 | A1* | 8/2013 | Shirabe | F01M 5/002<br>123/574 |
| 2015/0114369 | A1 | 4/2015 | Tanikawa et al. | |

* cited by examiner

POSITIVE CRANKCASE VENTILATION ("PCV") VALVE MOUNTING STRUCTURE

CROSS-REFERENCE TO RELATED APPLICATIONS

This application is based upon and claims priority to Japanese Patent Application Serial No. 2014-224163 filed on Nov. 4, 2014, the contents of which are incorporated herein by reference in their entirety for all purposes.

STATEMENT REGARDING FEDERALLY SPONSORED RESEARCH OR DEVELOPMENT

Not applicable.

BACKGROUND

The invention generally relates to a structure for mounting a positive crankcase ventilation valve (herein referred to as a "PCV" valve) to a cylinder head of an internal combustion engine, such as an engine for powering an automobile and/or any other vehicle engine. Further, the PCV valve may be mounted directly to an intake manifold of such an engine. Also, the PCV valve may direct and/or adjust flow of gas that may be recirculated from the engine and/or exhaust system of a vehicle, for example, back to the engine to enhance engine power delivery and efficiency.

FIG. 6 illustrates a known PCV valve mounting structure. As shown in FIG. 6, a blow-by gas passage 106 includes an upstream-side passage portion 108 and a downstream-side passage portion 112 formed in a cylinder head 102 and an intake manifold 104 of the engine, respectively. The upstream-side passage portion 108 and the downstream-side passage portion 112 of the blow-by gas passage 106 may communicate with each other when the cylinder head 102 and the intake manifold 104 come into contact. A PCV valve 100 is mounted within the upstream-side passage portion 108 and the downstream-side passage portion 112 to extend therebetween. In detail, the PCV valve 100 may adjust flow rate of blow-by gas flowing though the blow-by passage 106. A stepped recess portion 110, with a diameter larger than the downstream-side passage portion 112, is formed in the cylinder head 102 at an open end portion of the upstream-side passage portion 108.

The PCV valve 100 has a valve case 114, a valve member 116 positioned within and extending internally throughout the valve case 114 and a valve spring 118. The valve case 114 includes a main case portion 114*a* and a sub-case portion 114*b*, both main and sub case portions 114*a* and 114*b* being made of resin. The main case portion 114*a* and the sub-case portion 114*b* are joined to each other in the axial direction (i.e., the left-to-right direction in FIG. 6) to collectively define a gas passage 120. A valve seat 122 made of metal is held between a right side end portion of the main case portion 114*a* and a left side end portion of the sub-case portion 114*b* to be coaxial with both the main and sub-case portions 114*a* and 114*b*. The valve seat 122 has an annular plate shape with a metering hole 122*a* formed therein. The valve member 116 enters into the gas passage 120, so that a cross-sectional passage area (i.e. the open area) of the metering hole 122*a* of the valve seat 122 may be adjusted in response to the axial movement of the valve member 116. The valve spring 118 biases the valve member 116 in an upstream-side direction (i.e. toward the left in FIG. 6) with respect to the gas passage 120. The downstream-side end of the PCV valve 100 (i.e., the right-side end of the sub-case portion 114*b* in FIG. 6) is fitted into the open-ended portion of the downstream-side passage portion 112 of the intake manifold 104. The remaining portion of the sub-case portion 114*b* is fitted into the stepped recess portion 110 of the cylinder head 102, and the main case portion 114*a* is also fitted into the stepped portion 110. A metering space 124 is defined as the region between the inner circumferential surface of the metering hole 122*a* of the valve seat 122 and the outer circumferential surface (i.e. metering surface) of the valve member 116.

A first O-ring 126 seals the cylinder head 102 to the valve case 114 and may fit into a corresponding first O-ring groove (not shown in FIG. 6) in the main case portion 114*a*. Similarly, a second O-ring 128 seals the intake manifold 104 to the valve case 114 and may fit into corresponding second O-ring groove (not shown in FIG. 6) formed in the sub-case portion 114*b*. A gasket 130 is positioned between joint surfaces of the cylinder head 102 and the intake manifold 104 and is fitted into a corresponding gasket-receiving groove in the joint surface of the intake manifold 104.

U.S. Patent Application Publication No. US2011/0203559 (also published as Japanese Laid-Open Patent Publication No. 2011-169258) generally discloses a PCV mounting structure similar to that shown in FIG. 6.

In detail, the mounting structure shown in FIG. 6 involves two O-rings, i.e., the first O-ring 126 for sealing the cylinder head 102 to the valve case 114, and the second O-ring 128 for sealing the intake manifold 104 to the valve case 114 as described above. Such an arrangement may result in difficulty in mounting the O-ring 126 and the O-ring 128 to the main case portion 114*a* and the sub-case portion 114*b*, respectively. Further, the operations for forming the O-ring grooves in the main and sub-case portions 114*a* and 114*b* are relatively involved and/or time-consuming. Thus, such an arrangement as described above may lead to an increase in costs associated with manufacturing and/or maintaining, for example, the mounting structure.

In view of the challenges discussed above, there is a need in the art for a PCV valve mounting structure with fewer components needed for operation, thus also contributing to a commensurate reduction in production costs associated with such a PCV valve mounting structure.

SUMMARY

A PCV valve mounting structure in accordance with an embodiment includes a PCV valve (positive crankcase ventilation valve) mounted to an engine cylinder head and to an intake manifold. The cylinder head may contact the intake manifold at a defined surface. The PCV valve mounting structure has a gas passage, i.e. a passage able to accommodate "blow-by" gas, with an upstream-side passage portion in the cylinder head and a corresponding down-stream-side passage portion in the intake manifold. The upstream and the down-stream-side passage portions may be in fluid communication when the cylinder head contacts and/or joins the intake manifold. The blow-by gas passage receives the PCV valve therein such that an upstream side portion of a valve case of the PCV valve is inside the upstream-side passage portion of the cylinder head. Further, the PCV valve may be inserted into the gas passage, as described here, such that a downstream side portion of the valve case of the PCV valve is within the down-stream-side passage portion of the cylinder head when the cylinder head and the intake manifold join together. Moreover, once inserted into the gas passage, the PCV valve may adjust flow of blow-by gas flowing through the blow-by gas passage. In an embodiment, the PCV valve has a valve member movable longitudinally, i.e. along the length-wise direction of the PCV valve and/or gas passage, in response to a pressure variance between the upstream and downstream sides of the PCV valve that may occur while the PCV valve adjusts the cross-sectional area of the gas passage, i.e. as may be generally defined by a valve seat of the valve case. A gasket may be positioned on and/or at a surface where the cylinder head meets the intake manifold to prevent unwanted leakage of intake air through an intake air passage(s) formed in the engine. The gasket may have a seal portion positioned between the valve case of the PCV valve and either the cylinder head and the intake manifold to form a seal therebetween when the cylinder head contacts and/or joins the intake manifold.

In such an arrangement as described above, the gasket may seal the cylinder head to the intake manifold and, in an embodiment, the gasket may also seal the valve case of the PCV valve to either the cylinder head or the intake manifold. By allowing for the selection of the particular component to which the gasket forms a seal and/or seals, the overall number of components of the mounting structure may be minimized to accordingly reduce and/or control costs associated with manufacturing the mounting structure.

The PCV valve mounting structure may further include a seal ring that seals the valve case of the PCV valve to either of the cylinder head and the intake manifold.

In an embodiment, a receiving-side stepped portion may be formed on and/or at one of the joint surfaces of the cylinder head and the intake manifold. Similarly, an insertion-side stepped portion may be formed on the valve case of the PCV valve. In such an arrangement as described here, a seal portion of the gasket may be positioned between the receiving-side stepped portion and the insertion-side stepped portion to allow for relatively easy assembly and/or positioning of the seal portion between the valve case of the PCV valve and the cylinder head or the intake manifold.

In an embodiment, a seal member of the gasket may extend into both of the cylinder head and the intake manifold to allow for the simultaneous seal between the valve case of the PCV valve and the cylinder head, as well as between the valve case and the intake manifold.

The PCV valve may be positioned between two adjacent intake air delivery passages in the intake manifold. In detail, the blow-by gas passage may be formed in the engine between two adjacent delivery passages in the intake manifold or between two adjacent intake ports in the cylinder head in communication with the two adjacent delivery passages. With this arrangement, heat generated by operation the engine may be transmitted to the PCV valve as needed to thus prevent "icing" and/or "fixation," i.e. defined where a valve is fixed in a given position, of a valve member of the PCV valve against the wall of the gas passage when the engine is started in cold weather conditions.

DETAILED DESCRIPTION OF EXEMPLARY EMBODIMENTS

Figure 1:
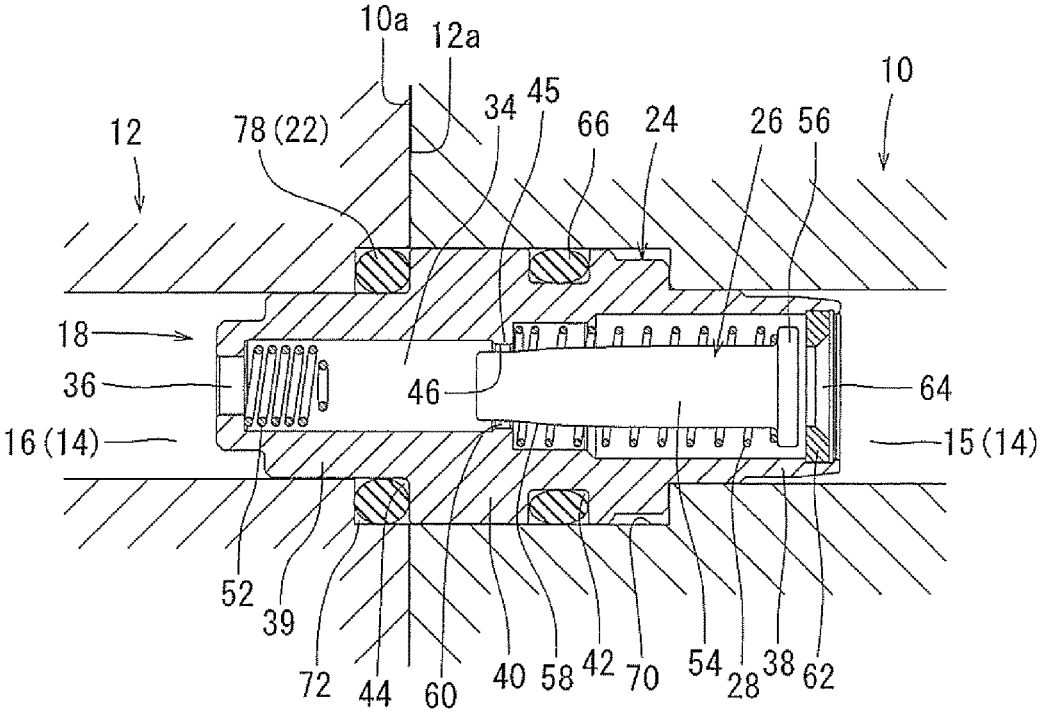
FIG. 1 is a cross-sectional view of a side of a PCV valve mounting structure in accordance with a first embodiment.

A PCV valve mounting structure, in accordance with a first embodiment, will now be described with reference to FIGS. 1 and 2. Referring to FIG. 1, a blow-by gas passage 14 may have an upstream-side passage portion 15 positioned upstream from a down-stream side passage portion 16, with respect to a direction of flow of blow by gas through the blow-by gas passage 14. The upstream-side passage portion 15 may be formed in a cylinder head 10 of an engine. In detail, the downstream-side end of the upstream-side passage portion 15 may open at a joint surface 10*a* of the cylinder head 10. The upstream-side end of the upstream-side passage portion 15 may be in fluid communication with a gas mixing and/or transference chamber (not shown in FIGS.) into which the blow-by gas may flow from combustion chambers of the engine. The mixing chamber, as described here, may be a "crank" chamber located in, for example, a crankcase of the engine or may be a separation chamber of an oil separator coupled with the crank chamber. Also, the cylinder head 10 may be made of aluminum alloy and an engine (not shown in the FIGS.) having a cylinder block configured to accept the cylinder head 10 may be a multi-cylinder engine, such as a four-cylinder engine.

The downstream-side passage portion 16 of the blow-by gas passage 14 may be formed in an intake manifold 12. The upstream-side end of the downstream-side passage portion 16 may open at a joint surface 12*a* of the intake manifold 12. The downstream-side end of the downstream-side passage portion 16 be in fluid communication with an intake air passage, such as one of distribution passages 20 (see FIG. 2) formed in the intake manifold 12 or an internal space of a serge tank (not shown). Further, the intake manifold 12 may be made of resin.

The cylinder head 10 and the intake manifold 12 may be joined by a joining device (not shown in the FIGS.), such as a screw fastening device, a clipping device, and a snap-fitting device, such that the joint surface 10*a* of the cylinder head 12 and the joint surface 12*a* of the intake manifold contact with each other. In detail, the cylinder head 10 may be joined to and/or coupled with the intake manifold 12 such that all discussed interior passage portions (i.e. portions 15 and 16) are aligned (i.e. in series) across a common axis extending lengthwise, i.e. horizontally as shown in FIG. 1. A PCV valve 18 may be disposed in the blow-by gas passage 14 to extend between the passage portions 15 and 16.

In an embodiment, the cylinder head 10 may be configured to define one or more of combustion chambers (not shown in the FIGS.), as well as intake and/or exhaust ports in correspondence with said chambers. Moreover, the intake manifold 12 may include a surge tank space (not shown in the FIGS.) and a plurality of delivery passages 20 (see FIG. 2). The delivery passages 20 may be connected to the downstream-side of the surge tank space and may distribute intake air (i.e. fresh air from outside the air intake and/or engine) to each intake port of the cylinder head 10.

Figure 2:
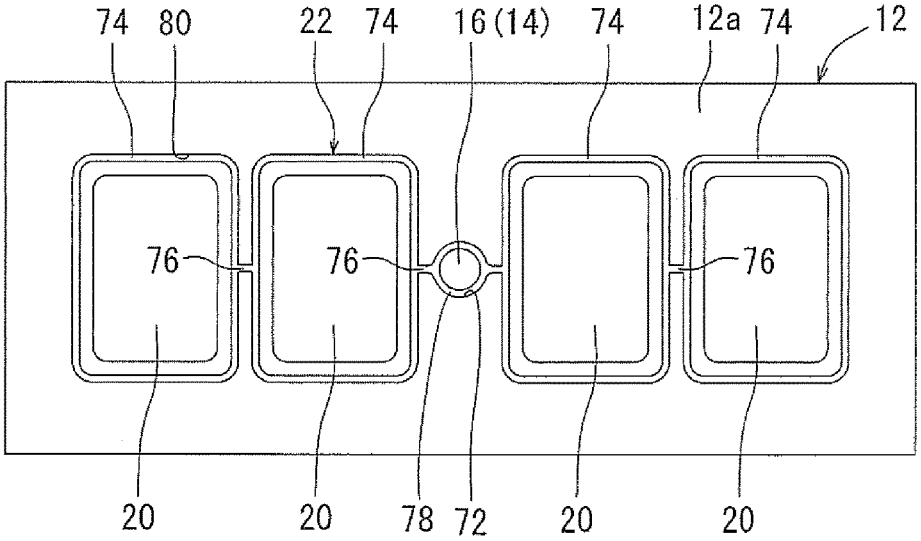
FIG. 2 is a schematic view illustrating a surface, such as a joining and/or contact surface, of a cylinder head of an intake manifold in accordance with the first embodiment.

FIG. 2 schematically illustrates the joint surface 12*a* of the intake manifold 12, i.e. where the intake manifold 12 contacts the cylinder head 10. As shown here, the delivery passages 20 may open at the joint surface 12*a*. Further, the number of the delivery passages 20 may correspond to the number of engine cylinders (i.e., the number of the combustion chambers). In the embodiment shown here, four delivery passages 20 are provided, and their respective openings, are arranged in a row in the left-to-right direction as shown in FIG. 2. The downstream-side passage portion 16 of the gas passage 14 may open at a central position, i.e. in between two of the openings of the delivery passages 20. Moreover, a seal member or a gasket 22 shown in FIG. 2 may be positioned between the cylinder head 10 and the intake manifold 12 to form a seal therebetween.

As shown in FIG. 1, the PCV valve 18 may have a valve case 24 that may generally enclose and/or define both a valve member 26 and a valve spring 28. Further, the valve case 24 may be made from a suitable rigid material, such as a metal having a desirable heat conductivity including stainless steel, aluminum alloy, iron and/or any composite formed thereof, and may be formed as a cylindrical tube, for example. The valve case 24, generally formed as a cylindrical tube as described here and/or as shown in at least FIG. 1, may extend lengthwise in the axial direction, i.e. the left-to-right direction in FIG. 1, to define a gas passage 34 through which gas may flow. In detail, the side (i.e. the right side as viewed in FIG. 1) corresponding to the upstream-side of the gas passage 34 of the valve case 24 will may be referred to as a "base end side." Likewise, the side positioned opposite to the base end side, (i.e. left side as viewed in FIG. 1) corresponding to the downstream side of the gas passage 34, may be referred to as a "leading end side."

The inner circumferential surface of the valve case 24, also a wall and/or surface of the gas passage 34, may be formed with a gradient and/or stepped shape, such that the diameter of the inner circumferential surface of the valve case 24 gradually decreases from the base end side toward the leading end side. Moreover, the opening of the gas passage 34 on the leading end side may define a gas outlet 36. Similar to that described above for the inner circumferential surface of the valve case 24, the outer circumferential surface of the valve case 24 may also have a stepped shape, such that the valve case 24 has a first small diameter portion 38 positioned near and/or disposed on the base end side, a second small diameter portion 39 positioned near and/or disposed on the leading end side, and a large diameter portion 40 positioned near and/or disposed at an intermediate and/or center position between the first small diameter portion 38 and the second small diameter portion 39. In detail, the large diameter portion 40 may be positioned nearer to the leading end of the valve case 24. An insertion-side stepped portion 44 may be formed at a position where the outer circumferential surface of the second small diameter portion 39 intersects an end surface (i.e. a radially-surface) on the leading end side of the large diameter portion 40.

An annular valve seat portion 45 (that may be shaped generally as a flange) may be formed on the inner circumferential surface of the gas passage 34 at a central position with respect to the axial direction of the gas passage 34. In detail, the annular valve seat portion 45 may be positioned closer to the leading end of the valve case 24 rather than the base end thereof. The valve seat portion 45 may be centered at and/or on an axis extending lengthwise, i.e. from left-to-right, across the cylinder head 10. The gas passage 34 may be centered around such an axis as described here and may have an inner diameter relatively smaller than that of the inner circumferential surface of the remaining portion of the gas passage 34. The inner diameter of the valve seat portion 45 may define a metering hole 46. A cushioning spring 52 may be disposed within the leading end side portion of the valve case 24. In detail, in an embodiment, the cushioning spring 52 may be a metal coil spring and thus be able to elastically inhibit excessive and/or otherwise undesirable movement of the valve member 26 toward the downstream side (i.e. the left side in FIG. 1). Further, the cushioning spring 52 may be inserted into the gas passage 34 via the base-end side opening of the valve case 24 until the cushioning spring 52 reaches an optimal and/or predetermined position, i.e. while still remaining within the leading end side portion of the valve case 24, after passing though the metering hole 46. Specifically, the cushioning spring 52 may be inserted into the gas passage 34 until touching and/or otherwise abutting a corresponding spring-receiving flange portion (not shown in FIG. 1) on an inner circumference of the gas outlet 36 at the base-end portion of the valve case 24.

In an embodiment, the valve spring 28 may be a metal coil spring and may be inserted into the gas passage 34 until the valve spring 28 contacts and/or otherwise abuts to the valve seat 45. Thus, the valve seat 45 may function as a receiving portion for the valve spring 28. In detail, valve spring 38 may be compressed to move and/or bias the valve member 26 toward the upstream side (right side in FIG. 1) of the gas passage 34.

The valve member 26 may be made of metal have a valve body portion 54 and a flange portion 56. The valve body portion 54 may be formed in a relatively rounded (i.e. cylindrical) rod shape. The flange portion 56 may protrude radially outward from the base end (i.e. the right end of the cylinder head 10 as shown in FIG. 1) of the valve body portion 54. In an embodiment, the outer circumferential surface of the flange portion 56 may be polygonal, i.e. having defined sides. In detail, the flange portion may be formed to have sides of equivalent length and/or at uniform angles to one another, i.e. to form a "regular" polygonal shape. The valve member 26 may be inserted into the base end side opening of the valve case 24 and may be move in the axial direction (left-to-right direction in FIG. 1) within the gas passage 34. In detail, the valve body portion 54 may be movably fitted into the valve spring 28 until the flange portion 56 contacts an end surface on the side of the base end of the valve spring 28. As described earlier, the polygonal outer circumferential surface of the flange portion 56 may slide and contact a side and/or wall surface of the gas passage 34, such that a plurality of flow openings (i.e. arranged in the circumferential direction) may be defined between the outer circumference of the flange portion 56 and the wall surface of the gas passage 34 for allowing passage of the blow-by gas.

A metering surface 58 may be formed on the outer circumference of the leading end portion (i.e. toward downstream-side end portion as introduced and explained earlier) of the valve body portion 54. In detail, the metering surface 58 may be tapered in a direction toward the leading end of the valve body portion 54 such that the leading end portion of the valve body portion 54 may insert into the metering hole 46 of the valve seat 45, and a metering gap 60 may be defined between the inner circumferential surface of the metering hole 46 and the metering surface 58 of the valve body portion 26. The valve body portion 26 may draw away from and/or otherwise retract from the metering hole 46 (or move in a direction toward the upstream side) (right side in FIG. 1). As may be necessary to accommodate such movement of the valve body portion 26 as described here, an effective open area (i.e., the cross-sectional area) of the metering gap 60 may expand as needed. In comparison, as the valve body portion 26 advances into the metering hole 46

(or moves in a direction toward the downstream side), the passage cross-sectional area of the metering gap 60 may decrease, i.e. such that the cross-sectional area of the metering gap 60 becomes smaller.

An annular removal-preventing member 62 may be fitted into the base-end side opening of the valve case 24 and may be fixed within the base end portion of the valve case 24 by a suitable fixation device and/or technique, such as by crimping. The inner circumference of the removal-preventing member 62 may define the gas inlet 64. Moreover, an O-ring 66 may be fitted into a corresponding O-ring receiving groove 42 formed in the outer circumferential surface of the valve case 24.

Components associated with mounting the PCV valve 18 into the cylinder head 10 will now be described in further detail. As shown in FIG. 1, a stepped recess 70 may be formed at the joint surface 10*a* of the cylinder head 10 such that the open end of the upstream-side passage portion 15 is enlarged, i.e. "coaxially" enlarged about an axis extending lengthwise across the cylinder head 10. The stepped recess 70 may be sized to accommodate and/or fit with the large diameter portion 40 of the valve case 24. Further, a receiving-side stepped recess 72 may be formed at the joint surface 12*a* of the intake manifold 12 such that the open end of the downstream-side passage portion 16 is coaxially enlarged. Further, in an embodiment, the inner diameter of the stepped recess 70 may equal to or substantially equal to the inner diameter of the stepped recess 72.

Referring now to that shown by FIG. 2, the gasket 22 may have a plurality of first seal portions 74, a plurality of connection portions 76 and a second seal portion 78. Each of the first seal portions 74 may be generally formed in the shape of rectangle and surround corresponding delivery passages 20. As described earlier, the number of the delivery passages 20 may correspond to the number of the engine cylinders. Thus, the number of the seal portions 74 may also correspond to the number of the engine cylinders. Each of the connection portions 76 may connect two adjacent seal portions 74. In further detail, one of the connection portions 76 connecting two adjacent seal portions 74 generally located at the center of the intake manifold 12 (i.e. in the orientation shown in FIG. 2) of the seal portions 74 may have the second seal portion 78. In detail, the second seal portion 78 may have an annular shape to elastically fit with the insertion-side stepped portion 44 of the valve case 24 and with the receiving-side stepped portion 72 of the intake manifold 12 (see FIG. 1). The gasket 22 may be inserted into a corresponding gasket fitting recess 80 formed at the joint surface 12*a*. Similarly, the second seal portion 78 may be fitted with the receiving-side stepped portion 72 at the same time the gasket 22 is fitted into the gasket fitting recess 80. In an embodiment, the receiving-side stepped portion 72 may be defined by a part of the gasket fitting recess 80. The second seal portion 78 may serve as a seal member and/or otherwise assist in sealing the PCV valve 18.

Prior to joining the cylinder head 10 and the intake manifold 12 together as shown in FIG. 1 (i.e. such that the cylinder head 10 is pressed against the intake manifold 12), the gasket 22 may be fitted into the gasket fitting recess 80 formed at the joint surface 12*a*, such that the seal portion 78 may be fitted with the receiving-side stepped portion 72 as described above. Next, the large diameter portion 40 of the valve case 24 may be fitted into the stepped recess portion 70, and at the same time, the smaller diameter portion 38 on the base-end side of the valve case 24 may be fitted into the upstream-side passage portion 15 that may be in fluid communication with the stepped recess portion 70. Resultantly, the gas inlet 64 of the valve case 24 may be aligned with the upstream-side passage portion 15 to allow for gas to pass as needed. Following, the cylinder head 10 and the intake manifold 12 may be jointed together, such that the small diameter portion 39 on the leading-end side of the valve case 24 may be fitted into the downstream-side passage portion 16 after passing through the second seal portion 78 of the gasket 22. Thus, the gas outlet 36 of the valve case 24 may be aligned with the downstream-side passage portion 16 to allow gas to pass through the gas outlet 36 into the downstream-side passage portion 16 as needed. As a result, the PCV valve 18 may be inserted into and/or mounted within the cylinder head 10 and the intake manifold 12 to extend between the upstream-side passage portion 15 of the cylinder head 10 and the down-stream side passage portion 16 of the intake manifold 12.

In the "mounted state" shown in FIG. 1 (i.e. in that the PCV 18 has been inserted into and/or retained within the cylinder head 10 as described above), the gasket 22 (see FIG. 2) may seal the joint surface 10*a* of the cylinder head 10 and the joint surface 12*a* of the intake manifold 12 to prevent possible leakage of intake air in, for example, the upstream-side passage portion 15. In addition, the second seal portion 78 of the gasket 22 may be positioned in between the insertion-side stepped portion 44 and the receiving-side stepped portion 72 of the intake manifold 12 to form a seal therebetween. Further, the O-ring 66 may be positioned between the valve case 24 and the inner circumferential surface of the stepped recess 70 of the cylinder head 10 to form a seal therebetween. Furthermore, the end surface on the base-end side of the large diameter portion 40 may press against and/or contact the bottom surface on the base-end side of the stepped recess 70 of the cylinder head 10.

Upon starting the engine, a negative pressure produced in an intake passage (not shown in the drawings) of the intake manifold 12 may inside of a communication passage (not shown in the drawings) formed in the engine to facilitate the flow of the blow-by as may be needed for routine engine operation. Next, the blow-by gas may flow into passages 15 and 16. Also, in an embodiment, fresh air (i.e. atmospheric air) suctioned into the intake manifold 12 may be redirected into a fresh air introduction passage (not shown in the FIGS.). During redirection and/or re-circulation of the blow-by gas throughout the various passages, i.e. passages 15 and 16 and/or the fresh air introduction passage as described here, the PCV valve 18 may operate according to load applied to the engine and/or the negative pressure (relative to ambient air) produced in the intake passage, such that the quantity of the redirected and/or re-circulated blow-by gas flowing from the upstream-side passage 15 to the downstream-side passage 16 of the blow-by gas passage 14 may be controlled.

In detail, the valve member 26 of the PCV valve 18 may move to a position where force, such as a returning and/or biasing force, of the valve spring 26 applied to the valve member 26 may be adjusted to compensate for and/or counterbalance to the intake negative pressure or pressure variances in, for example, the passages 15 and 16. Should a sudden reversal of gas flow direction occur, due to, for example a "misfire" and/or "backfire," defined as irregular fuel combustion in the combustion chambers of the engine, the valve member 26 may move toward the removal-preventing member 62 of the valve case 24 such that the flange portion 56 of the valve member 26 may be seated on the removal-preventing member 62 to close the gas inlet 64. Accordingly, the blow-by gas passage 14 and the PCV valve 18 may be considered to constitute significant components of a blow-by gas recirculation system.

With the PCV valve mounting structure described above, the second seal portion 78 that may also be a part of the gasket 22, may form a seal between the intake manifold 12 and the valve case 24 of the PCV valve 24. Therefore, the number of components necessary for the PCV valve mounting structure may be minimized. Accordingly, the costs associated with manufacturing the gas recirculation system may be controlled.

Further, the O-ring 66 may form a seal between the cylinder head 10 and the valve case 24 of the PCV valve 18 to reliably prevent against unwanted leakage of blow-by gas from the passages 15 and 16 within the cylinder head 10.

Moreover, the second seal portion 78 of the gasket 22 may be positioned between the receiving-side stepped portion 72 formed at the joint surface 12*a* of the intake manifold 12 and the insertion-side stepped portion 44 formed on the valve case 24. Thus, the seal portion 78 may be assembled relatively easily as needed to seal the intake manifold 12 to the valve case 24.

In addition, the downstream-side passage portion 16 of the intake manifold 12 may be positioned between two adjacent delivery passages 20 (see FIG. 2). The delivery passages 20 may be in fluid communication with the intake ports (not shown in the FIGS.) of the cylinder head 10. Alternatively described, the PCV valve 18 may be positioned between two adjacent intake ports. This arrangement may increase the quantity of heat able to be transmitted from the cylinder head 10 to the PCV valve 18. This may inhibit unwanted adhesion and/or fixation of the valve member 26 that may be caused due to ice forming on and/or between the various components described here when the engine may be started in relatively cold temperatures.

Figure 3:
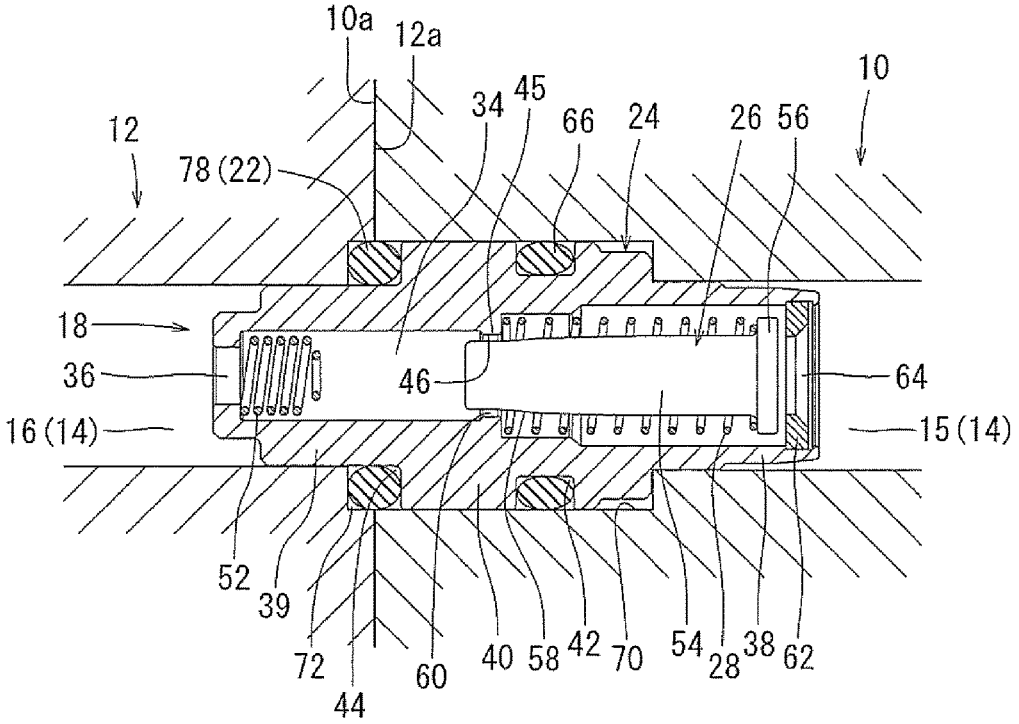
FIG. 3 is a cross-sectional view of a side of a PCV valve mounting structure in accordance with a second embodiment.

A second embodiment will now be described with reference to FIG. 3. The second embodiment is a modification of the first embodiment and thus shares many parts, components fixtures and/or the like with the first embodiment. Thus, like components are labeled with like reference numerals as the first embodiment, and a redundant description of the same will be omitted. The second embodiment differs from the first embodiment in that the second seal portion 78 of the gasket 22 extends into the open end of the stepped recess 70 of the cylinder head 10. Alternatively put, the second seal portion 78 extends across a joint plane where the joint surface 10*a* of the cylinder head 10 and the joint surface 12*a* of the intake manifold 12 are joined together. Thus, the second seal portion 78 may form a seal between the intake manifold 12 and the valve case 24 of the PCV valve 24 and may also form a seal between the cylinder head 10 and the valve case 24 of the PCV valve 24. For at least this reason, in particular as related to this (i.e. the second) embodiment, the O-ring 66 may be omitted.

Figure 4:
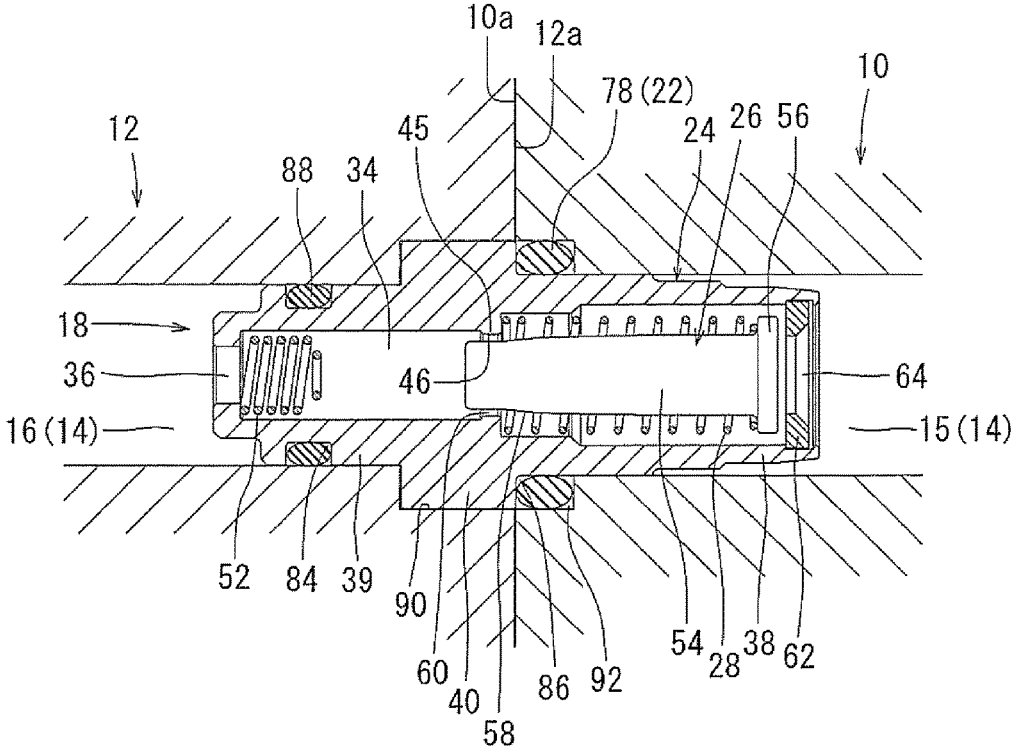
FIG. 4 is a cross-sectional view of a side of a PCV valve mounting structure in accordance with a third embodiment.

A third embodiment will now be described with reference to FIG. 4. As discussed above for the second embodiment, this (i.e. third) embodiment is a modification of the first embodiment and thus shares many parts, components, fixtures and/or the like with the first embodiment. Therefore, like components are labeled with like reference numerals as the first embodiment, and a redundant description of the same will be omitted. As shown in FIG. 4, this (third) embodiment differs from the first embodiment primarily in that (i) the O-ring 66 may be replaced with O-ring 88 and in that (ii) the arrangement position of the second seal portion 78 of the gasket 22 is changed. In this connection as shown by FIG. 4, the small diameter portion 39 on the leading-end side of the valve case 24 may include an annular groove 84 for accepting and/or fitting with the O-ring 88. The annular groove 84 may be toward the center of the cylinder head 10 (relative to the axial direction) of the outer circumferential surface of the small diameter portion 39. In addition, an insertion-side stepped portion 86 may be formed at a position where the outer circumferential surface of the small diameter portion 38 on the base-end side of the valve case 24 intersects the base end surface (i.e. the internal radial surface) of the large diameter portion 40.

Also, a stepped recess 90 may be formed at the joint surface 12*a* of the intake manifold 12 such that the open end of the downstream-side passage portion 16 may be enlarged in the radial direction, i.e. coaxially enlarged. The stepped recess 90 may be sized to fit with the large diameter portion 40 of the valve case 24. Likewise, receiving-side stepped portion 92 may be formed at the joint surface 10*a* of the cylinder head 10 such that the open end of the upstream-side passage portion 15 is coaxially enlarged. In this embodiment, the receiving-side stepped portion 92 may be axially opposed to the insertion-side stepped portion 86. The inner diameter of the receiving-side stepped portion 92 may be equal to or substantially equal to the inner diameter of the stepped recess 90.

Moreover, the gasket 22 may be fitted into the gasket fitting recess 80 formed at the joint surface 12*a* of the intake manifold 12, similar to that shown and discussed in connection with the first embodiment. However, in the third embodiment, the gasket 22 may be fitted into a gasket fitting recess (not shown in the FIGS.) formed at the joint surface 10*a* of the cylinder head 10 and configured to have a shape similar to that of the gasket fitting recess 80. Thus, each of the seal portions 74 may surround the open end of the corresponding intake port of the cylinder head 10, i.e. similar to that shown by FIG. 2.

With this (i.e. third) embodiment, prior to joining the cylinder head 10 and the intake manifold 12 together, the gasket 22 may be fitted into the gasket fitting recess formed at the joint surface 10*a* of the cylinder head 10. At the same time, the second seal portion 78 of the gasket 22 may be fitted into the receiving-side stepped portion 92 of the cylinder head 10. Alternatively, the large diameter portion 40 of the valve case 24 may be fitted into the stepped recess portion 90 of the intake manifold 12, and at the same time, the small diameter portion 39 on the leading end side of the valve case 24 may be fitted into the downstream-side passage portion 16 on the downstream side of the stepped recess portion 90. Thus, the gas outlet 36 of the valve case 24 may be aligned with the downstream-side passage portion 16. Thereafter, the cylinder head 10 and the intake manifold 12 may be joined together, such that the small diameter portion 38 on the base-end side of the valve case 24 may be fitted into the upstream-side passage portion 15 after passing through the second seal portion 78 of the gasket 22. Thus, the gas inlet 64 of the valve case 24 may be aligned with the upstream-side passage portion 15 to allow for the PCV valve 18 to be mounted within the cylinder head 10 and the intake manifold 12. In detail, the PCV valve 18 may extend between the upstream-side passage portion 15 of the cylinder head 10 and the down-stream side passage portion 16 of the intake manifold 12.

While the PCV 18 is mounted within the cylinder head 10 and the intake manifold 12 as shown in FIG. 4, similar to the first embodiment, the gasket 22 (see FIG. 2) may form a seal between the joint surface 10*a* of the cylinder head 10 and the joint surface 12*a* of the intake manifold 12. In addition, the second seal portion 78 of the gasket 22 may be positioned between the insertion-side stepped portion 86 of the valve case 24 and the receiving-side stepped portion 92 of cylinder head 10 so as to form a seal therebetween. Further, the end surface on the leading-end side of the large diameter portion 40 may abut and/or otherwise contact or slightly spaced from the bottom surface on the base-end side of the stepped recess 90 of the intake manifold 12.

The PCV valve mounting structure of this (i.e. third) embodiment, similar to the first embodiment, provides the second seal portion 78, that is a part of the gasket 22, to form seal between the intake manifold 12 and the valve case 24 of the PCV valve 24. Therefore, the number of components necessary for the mounting structure may be minimized to thus reduce costs associated with manufacturing of the gas recirculation system.

Further, the O-ring 88 may seal the intake manifold 12 to the valve case 24 of the PCV valve 18 to prevent potential leakage of the blow-by gas.

Moreover, the second seal portion 78 of the gasket 22 may be positioned between the receiving-side stepped portion 92 formed at the joint surface 10*a* of the cylinder head 10 and the insertion-side stepped portion 86 formed on the valve case 24. Thus, the second seal portion 78 may be easily assembled for sealing between the cylinder head 10 and the valve case 24.

Figure 5:
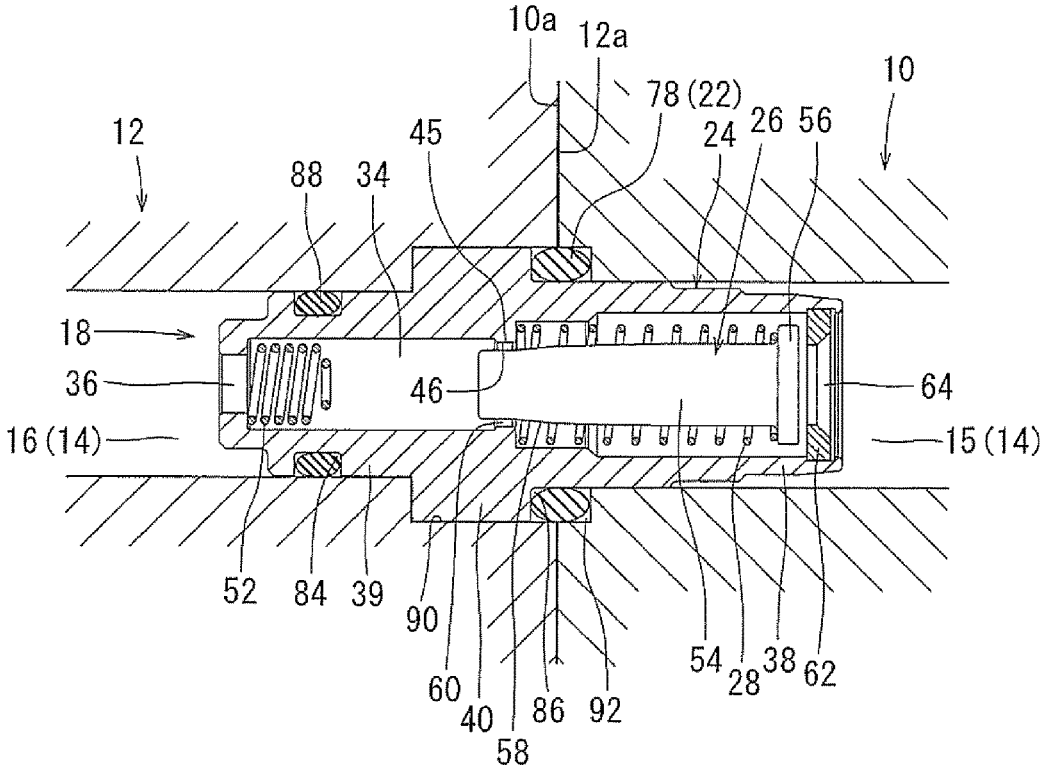
FIG. 5 a cross-sectional view of a side of a PCV valve mounting structure in accordance with a fourth embodiment.
Figure 6:
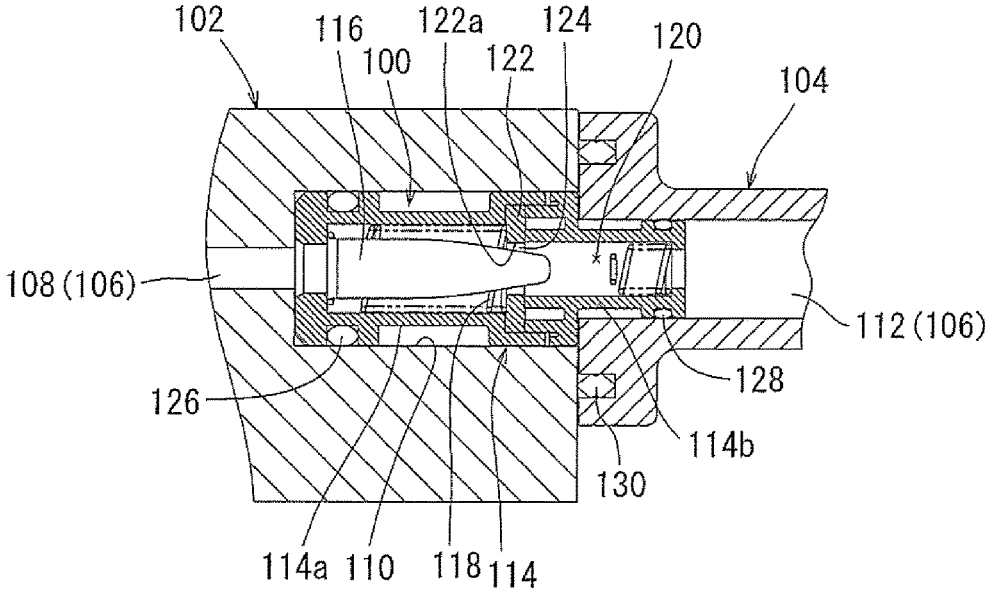
FIG. 6 PRIOR ART
FIG. 6 is a cross-sectional view of a side of a PCV valve mounting structure according to prior art.

A fourth embodiment will now be described with reference to FIG. 5. This embodiment is a modification of the third embodiment. Therefore, like components are labeled with like reference numerals as the third embodiment, and a redundant description of the same will be omitted. The fourth embodiment is different from the third embodiment in that the second seal portion 78 of the gasket 22 extends into the open end of the stepped recess 90 of the intake manifold 12. Alternatively described, the second seal portion 78 extends across a joint plane between the cylinder head 10 and the intake manifold 12. Thus, the second seal portion 78 may seal the cylinder head 10 to the valve case 24 of the PCV valve 24 and may also seal the intake manifold 12 to the valve case 24. For at least this reason, in particular as shown for this (fourth) embodiment, the O-ring 88 may be omitted.

The above-described embodiments may be modified further in various ways. For example, the embodiments have been described for the PCV valve mounting structure for mounting one PCV valve to one blow-by gas passage connected to the engine. However, for example, if a plurality of blow-by gas passages are arranged in parallel with each other are also connected to the engine, a plurality of PCV valve mounting structures may be incorporated and/or configured with the blow-by gas passages as desired.

In an embodiment, the valve case 24 may be made of resin instead of metal. Further, at least one of the valve portion 26, the valve spring 28 and the cushion spring 52 may be made of resin.

Although the blow-by gas passage 14 into which the PCV valve 18 may be mounted is located at a position between the delivery passages 20 or between the intake ports, the blow-by gas passage 14 may be located, for example, on the outer peripheral side of the joint surfaces.

Further, the cross-sectional shape of the seal portion 78 of the gasket 22 may not be limited to a circular shape but may be a rectangular shape or any other shape. Also, the number of the first seal portions 74 of the gasket 22 may not be limited to four but may be one, two, three or five or more to correspond to the number of the delivery passages 20. Even further, the O-rings 66 and 68 may be replaced with seal rings having a rectangular cross sectional shape or any other cross sectional shape.

The various examples described above in detail with reference to the attached drawings are intended to be representative and thus not limiting. The detailed description is intended to teach a person of skill in the art to make, use and/or practice various aspects of the present teachings and thus is not intended to limit the scope of the invention. Furthermore, each of the additional features and teachings disclosed above may be applied and/or used separately or with other features and teachings to provide improved PCV valve mounting structures, and/or methods of making and using the same.

Moreover, the various combinations of features and steps disclosed in the above detailed description may not be necessary to practice the invention in the broadest sense, and are instead taught to describe representative examples. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A positive crankcase ventilation (PCV) valve mounting structure for mounting a PCV valve to an engine cylinder head and to an intake manifold, wherein the engine cylinder head contacts the intake manifold at a joint surface of the cylinder head and a joint surface of the intake manifold, the PCV valve mounting structure comprising:

a blow-by gas passage with an upstream-side passage portion in the cylinder head and a down-stream-side passage portion in the intake manifold;

wherein the upstream-side passage portion and the down-stream-side passage portion allow for fluid communication when the cylinder head and the intake manifold are joined together;

wherein the blow-by gas passage is configured to receive the PCV valve therein such that an upstream side portion of a valve case of the PCV valve is positioned within the upstream-side passage portion and that a downstream side portion of the valve case of the PCV is positioned within the down-stream-side passage portion when the cylinder head and the intake manifold are joined together;

wherein the PCV valve adjusts a flow of blow-by gas flowing through the blow-by gas passage; and a gasket positioned between the joint surface of the cylinder head and the joint surface of the intake manifold;

wherein the gasket includes a seal portion positioned between the valve case of the PCV valve and one of the cylinder head and the intake manifold, the seal portion contacting the valve case and contacting one of the cylinder head and the intake manifold to form a seal between the valve case and one of the cylinder head and the intake manifold when the cylinder head and the intake manifold are joined together.

2. The PCV valve mounting structure of claim 1, further comprising:

a seal ring that seals the valve case of the PCV valve to the other of the cylinder head and the intake manifold.

3. The PCV valve mounting structure of claim 1, wherein:

a receiving-side stepped portion is formed at the joint surface of one of the cylinder head and the intake manifold;

an insertion-side stepped portion is formed on the valve case of the PCV valve; and the seal portion of the gasket is interposed between the receiving-side stepped portion and the insertion-side stepped portion.

4. The PCV valve mounting structure of claim 1, wherein a seal member of the gasket is arranged to extend into the cylinder head and the intake manifold.

5. The PCV valve mounting structure of claim 1, wherein:

the seal portion of the gasket is arranged to extend across the joint surface of the cylinder head and the joint surface of the intake manifold.

6. The PCV valve mounting structure of claim 1, wherein the PCV valve is arranged between two adjacent delivery passages formed in the intake manifold for distributing intake air.

7. The PCV valve mounting structure of claim 1, wherein the seal portion is formed integrally with the gasket.

8. The PCV valve mounting structure of claim 1, wherein the engine includes at least one intake air delivery passage extending across the joint surface of the cylinder head and the joint surface of the intake manifold; and wherein the gasket is configured to prevent leakage of intake air from the engine via the at least one intake air delivery passage.

9. A positive crankcase ventilation (PCV) valve mounting structure for mounting a PCV valve to an engine cylinder head and to an intake manifold, the engine cylinder head and the intake manifold being joined together at a joint surface of the cylinder head and a joint surface of the intake manifold, the PCV valve mounting structure comprising:

a blow-by gas passage with an upstream-side passage portion in the cylinder head and a down-stream-side passage portion in the intake manifold;

wherein the upstream-side passage portion and the down-stream-side passage portion allow for fluid communication upon joining the cylinder head to the intake manifold;

wherein the blow-by gas passage is configured to receive the PCV valve therein such that an upstream side portion of a valve case of the PCV valve is positioned within the upstream-side passage portion and that a downstream side portion of the valve case is positioned within the down-stream-side passage portion when the cylinder head and the intake manifold are joined together;

wherein the PCV valve is configured to adjust a flow of blow-by gas flowing through the blow-by gas passage; and a seal accommodation space in the blow-by gas passage between an outer circumferential surface of the valve case of the PCV valve and an inner circumferential wall of at least one of the upstream-side passage portion and the downstream-side passage portion;

wherein at least a part of the seal accommodation space is positioned proximal to or across the joint surface of the cylinder head and the joint surface of the intake manifold, so that the at least a part of the seal accommodation space is open to at least one of the joint surfaces; and a first seal member disposed within the seal accommodation space such that the first seal member prevents leakage of the blow-by gas from the blow-by gas passage to an outside of the engine between the joint surface of the cylinder head and the joint surface of the intake manifold.

10. The PCV valve mounting structure of claim 9, wherein:

the seal accommodation space is defined between a first stepped portion formed at the joint surface of one of the cylinder head and the intake manifold and a second stepped portion formed on the outer circumferential surface of the valve case of the PCV valve.

11. The PCV valve mounting structure of claim 9, wherein:

the engine includes at least one intake air delivery passage extending across the joint surface of the cylinder head and the joint surface of the intake manifold;

the first seal member is connected to a second seal member;

the second seal member is positioned between the joint surface of the cylinder head and the joint surface of the intake manifold and configured to prevent leakage of air.

12. The PCV valve mounting structure of claim 11 wherein the second seal member is formed integrally with the first seal member.

* * * * *